US008002437B2

(12) United States Patent
Sohn

(10) Patent No.: US 8,002,437 B2
(45) Date of Patent: Aug. 23, 2011

(54) LIGHT EMITTER TO BE ATTACHED TO CAPS

(76) Inventor: Dae Up Sohn, Seoul (KR)

( * ) Notice: Subject to any disclaimer, the term of this patent is extended or adjusted under 35 U.S.C. 154(b) by 177 days.

(21) Appl. No.: 12/356,597

(22) Filed: Jan. 21, 2009

(65) Prior Publication Data

US 2009/0190333 A1 Jul. 30, 2009

(30) Foreign Application Priority Data

Jan. 24, 2008 (KR) ..... 10-2008-0007630

(51) Int. Cl.
*F21V 33/00* (2006.01)

(52) U.S. Cl. ..... 362/249.09; 362/249.01; 362/249.1; 362/287

(58) Field of Classification Search ..... 362/187–188, 362/197, 199, 105–106, 285–289, 167, 372, 362/164, 249.1, 249.01–249.03, 232, 239, 362/419–422, 427, 249.04, 249.07, 249.09, 362/249.11

See application file for complete search history.

(56) References Cited

U.S. PATENT DOCUMENTS

| | | | |
|---|---|---|---|
| 1,197,427 | A | 9/1916 | Arnold |
| 2,524,881 | A | 10/1950 | Chambers |
| D188,129 | S | 7/1960 | Wansky |
| 3,032,647 | A | 5/1962 | Wansky et al. |
| D228,465 | S | 9/1973 | Louis |
| 4,215,389 | A | 7/1980 | Colangelo |
| 4,298,913 | A | 11/1981 | Lozar |
| 4,406,040 | A | 9/1983 | Cannone |
| 4,964,023 | A | 10/1990 | Nishizawa |
| 5,357,409 | A | 10/1994 | Glatt |
| 5,460,346 | A | 10/1995 | Hirsch |
| 5,467,992 | A | 11/1995 | Harkness |
| 5,485,358 | A | 1/1996 | Chien |
| 5,541,816 | A | 7/1996 | Miserendino |
| D374,731 | S | 10/1996 | Anwyl-Davies |
| D376,469 | S | 12/1996 | Harkness |
| 5,741,060 | A | 4/1998 | Johnson |
| 5,911,494 | A | 6/1999 | Lary |
| 5,991,494 | A | 11/1999 | Otsuka |

(Continued)

FOREIGN PATENT DOCUMENTS

FR 2 833 139 A1 6/2003

(Continued)

OTHER PUBLICATIONS

"LEDHedz," Potentials Magazine, Dec. 9, 2002, p. 65, Nielsen Business Media, Inc., New York, NY.

*Primary Examiner* — Robert May
(74) *Attorney, Agent, or Firm* — Craig A. Fieschko, Esq.; DeWitt Ross & Stevens S.C.

(57) ABSTRACT

A light emitter to be attached to caps includes a case having several second lamps formed at a front surface thereof, a power switch attached to an outer surface of the case, a battery installed inside the case to provide power, a guide channel formed at a center of the case, a mounting clip formed at the outer surface of the case, a sub-body having a first lamp at a front surface thereof and being coupled to the guide channel, and a switch unit for controlling on/off operation of the first lamp. A user may move the sub-body back and forth to activate the first lamp, and may rotate the sub-body to alter the illumination angle of the first lamp.

20 Claims, 5 Drawing Sheets

U.S. PATENT DOCUMENTS

| | | | |
|---|---|---|---|
| 6,168,286 | B1 | 1/2001 | Duffy |
| 6,206,543 | B1 | 3/2001 | Henry |
| 6,619,813 | B1 | 9/2003 | Schnell |
| 6,634,031 | B1 | 10/2003 | Schlapkohl |
| 6,644,829 | B1 | 11/2003 | Tracy |
| 6,659,618 | B2 | 12/2003 | Waters |
| 6,719,417 | B2 | 4/2004 | Hay et al. |
| 6,719,437 | B2 | 4/2004 | Lary et al. |
| 6,721,962 | B1 | 4/2004 | Polaire |
| 6,733,150 | B1 | 5/2004 | Hanley |
| D507,065 | S | 7/2005 | Sohn |
| 6,957,905 | B1 | 10/2005 | Pritchard |
| 7,000,841 | B2 | 2/2006 | Becker |
| 7,118,241 | B2 | 10/2006 | Sohn |
| 7,163,309 | B2 | 1/2007 | Sohn |
| 2003/0201874 | A1 | 10/2003 | Wu et al. |
| 2004/0130889 | A1 | 7/2004 | Kinsman et al. |
| 2004/0145888 | A1 | 7/2004 | Sohn |
| 2005/0128737 | A1 | 6/2005 | Pare |
| 2006/0157569 | A1 | 7/2006 | Becker |
| 2006/0198245 | A1 | 9/2006 | Cheung |
| 2006/0227540 | A1 | 10/2006 | Sohn |

FOREIGN PATENT DOCUMENTS

| | | | |
|---|---|---|---|
| JP | 2003-272402 | A | 9/2003 |
| KR | 20-2000-00085 | U | 5/2000 |
| KR | 10-0282715 | B1 | 2/2001 |
| KR | 20-0375257 | Y1 | 2/2005 |
| KR | 20-0376166 | Y1 | 3/2005 |
| WO | WO 2004/064555 | A | 8/2004 |

LIGHT EMITTER TO BE ATTACHED TO CAPS

FIELD OF THE INVENTION

The present invention relates to a light emitter to be attached to caps. More particularly, the present invention relates to a light emitter to be attached to caps, in which the light emitter is detachably installed on a visor of the cap to provide an illuminated field to a user.

BACKGROUND OF THE INVENTION

A user puts on a cap to (for example) protect the user's face from sunlight, and to prevent sweat from running down to the user's face during climbing mountains or fishing.

If a light emitting device is mounted on a visor of the cap, the user's hands are set free, so that the user's freedom of activity is improved. In addition, the direction of the light emission can track the user's sight line, so that the user can better see.

To illustrate such advantages, the applicant of the present invention has filed "a light emitter to be attached to caps", Korean Utility Model Registration No. 0312151, which corresponds to U.S. Pat. Nos. 7,118,241 and 7,163,309, and Canadian Patent No. 2,535,295.

FIG. 1 is a view representing a light emitter according to the related art.

As shown in FIG. 1, the conventional light emitter includes a case 22 forming a body, several lamps 24 installed at a front side of the case 22 while being spaced apart from each other, a switch member 26 installed at a side of the case 22, a battery incorporated in the case 22, and a clip 28 which is formed at an upper surface of the case 22 and has an end integrally coupled with the case 22 to elastically flex outwardly therefrom.

However, according to the related art, since the lamps installed at the front side of the case are simultaneously turned on or off by a single switch, the light emitter's ability to adjust the area or the amount of illumination, for example to save the battery, is limited.

Also, when the light emitter is carried in a knapsack or a pocket, the switch can be turned on regardless of the user's intention. In this case, the lamps may be turned on simultaneously, so that the battery may be discharged in contrast with the user's wishes.

In addition, since all of the lamps are fixedly directed toward the forward direction, if the user wants to change the direction of illumination, the user must turn his or her head to the intended direction.

Furthermore, in the case of short range illumination, a small quantity of light is required as compared to the quantity required for long range illumination. However, the conventional light emitter can not adjust the amount of emitted light according to the field to be illuminated.

SUMMARY OF THE INVENTION

The present invention addresses the problems of the prior art, and an object of the present invention is to provide a light emitter to be attached to caps, which is an improvement of Korean Utility Model Registration No. 0312151. According to the light emitter of the present invention, some of a plurality of lamps on the light emitter can be independently turned on/off by moving them back and forth, and an angle of an individual lamp can be adjusted such that the emission direction of the lamp can be changed upwardly and downwardly, and the amount of radiant light can be changed by adjusting the angle of a lamp, in a manner convenient to the user.

In addition, another object of the present invention is to provide a light emitter to be attached to caps, in which some lamps, which are independently adjusted, are set to have a strong luminosity as compared with that of the remaining lamps so that the user can utilize various combinations of lamps.

Still another object of the present invention is to provide a light emitter to be attached to caps, in which an additional switch unit is provided to prevent a battery from being unintentionally discharged even if a power switch is turned on by mistake.

Still yet another object of the present invention is to provide a light emitter to be attached to caps, in which an auxiliary battery is provided within the lamp equipped with the additional switch unit such that the lamp can be operated regardless of the discharge state of a main battery.

Still yet another object of the present invention is to provide a light emitter to be attached to caps, in which the light emitter can be fixed to a shirt pocket of the user to emit light forwardly when some of its lamps, which are independently adjustable, are arranged at a right angle.

The foregoing and and/or other aspects of the present invention are achieved by providing a light emitter including a case having a plurality of second lamps formed at a front surface thereof, a power switch attached to an outer surface of the case, a battery installed inside the case to provide power, a guide channel formed at a center of the case, a mounting clip formed at the outer surface of the case, and a sub-body having a first lamp at a front surface thereof and being coupled to the guide channel to move back and forth or rotate, and a switch unit, which allows the first lamp to be turned on upon a forward movement of the sub-body and turned off upon a backward movement of the sub-body.

As described above, according to the present invention, the user can adjust the distance and the amount of radiant light by moving the sub-body equipped with the first lamp back and forth such that the first lamp is independently turned on. In addition, the sub-body is rotatable such that the user can adjust the illumination angle without moving the head of the user. The light emitter can be fixed to a pocket to emit light in the forward direction by arranging the sub-body at a right angle with respect to the case.

In addition, an additional switch unit for the first lamp can be provided such that the user can adjust the amount of battery consumption.

BRIEF DESCRIPTION OF THE DRAWINGS

FIGS. 6 to 9 are enlarged partial views representing a switch unit applied to the light emitter of FIG. 5, wherein FIG. 6 represents a state in which the sub-body moves backward, FIG. 7 represents a state in which the sub-body moves forward, FIG. 8 represents a state in which the sub-body rotates downward by a predetermined angle, and FIG. 9 represents a state in which the sub-body rotates into an upright position.

DETAILED DESCRIPTION OF PREFERRED VERSIONS OF THE INVENTION

Hereinafter, a preferred version of the present invention will be described in detail with reference to the accompanying drawings.

Figure 1:
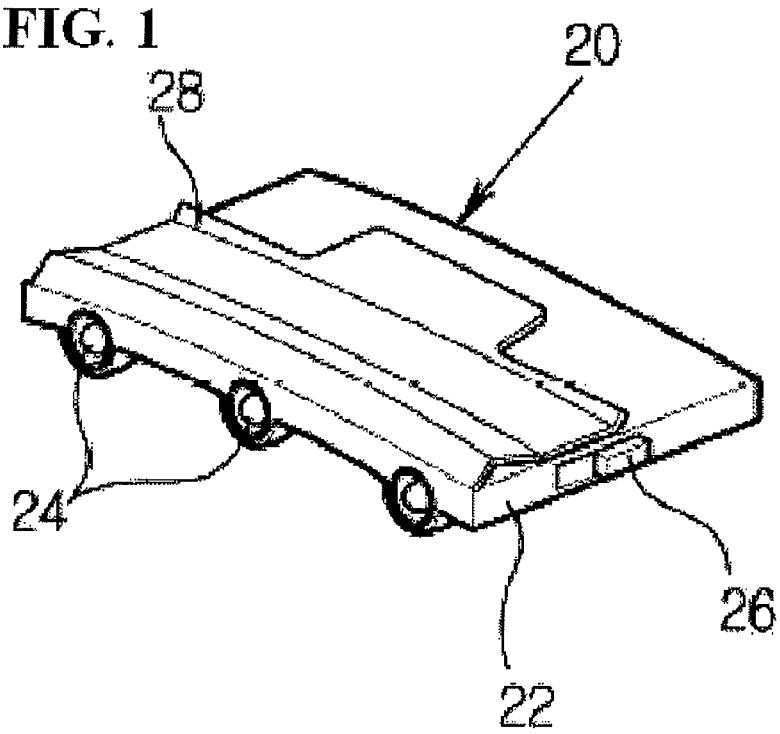
FIG. 1 is view representing a light emitter according to the related art.
Figure 2:
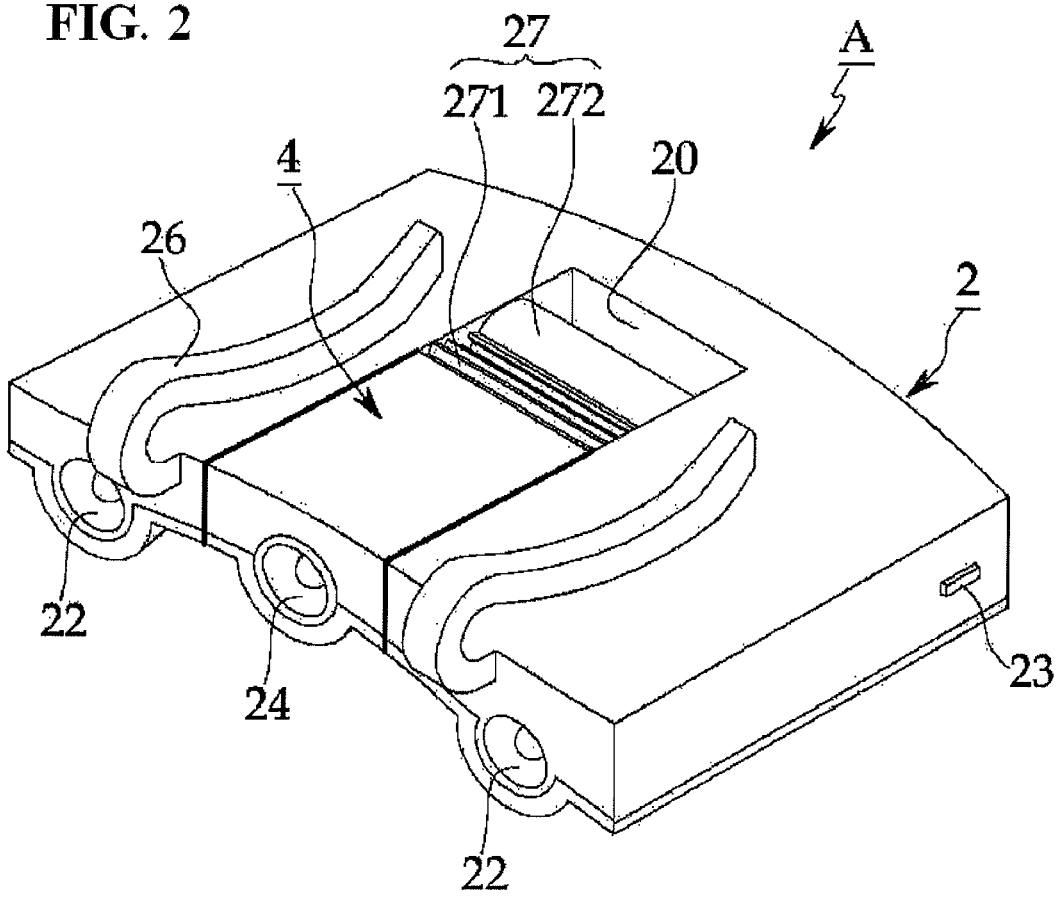
FIG. 2 is a perspective view representing a light emitter to be attached to a cap according to the present invention.
Figure 3:
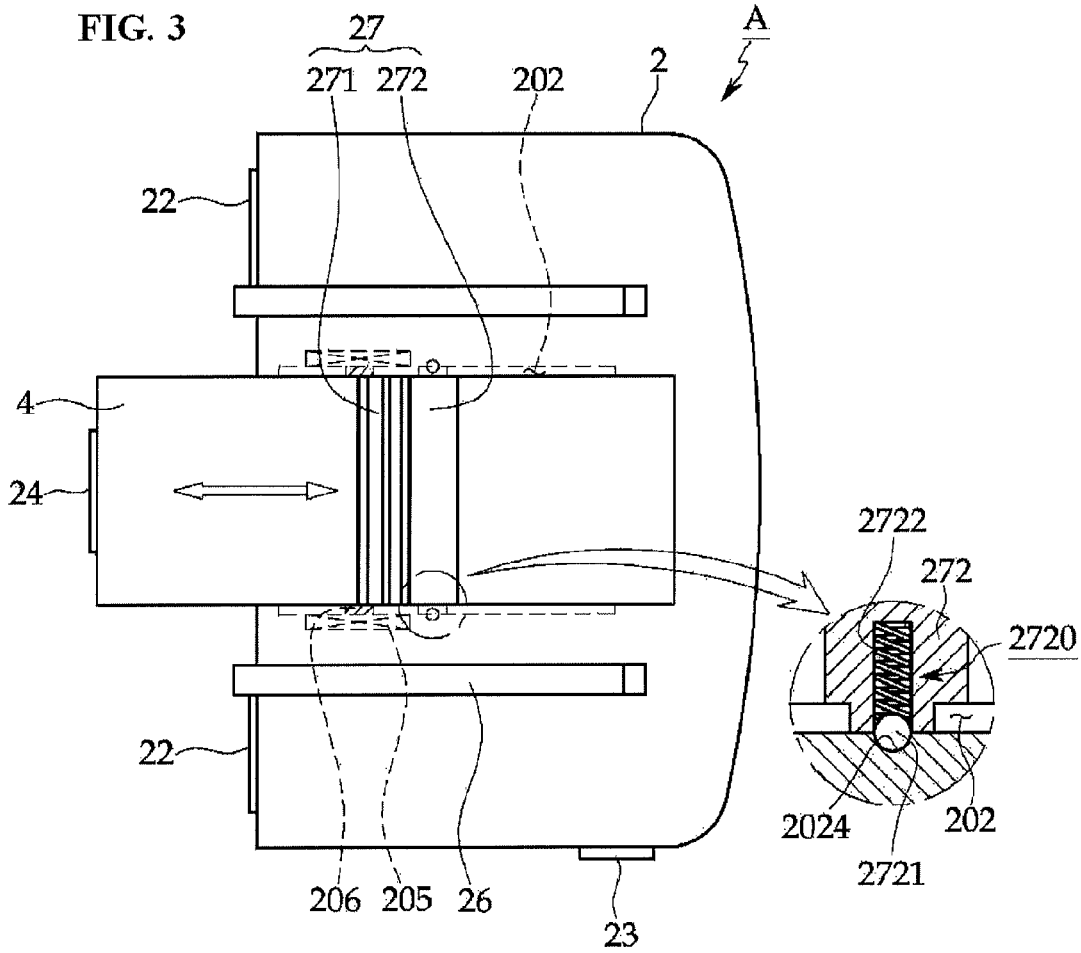
FIG. 3 is a plan view of the light emitter of FIG. 2.
Figure 4:
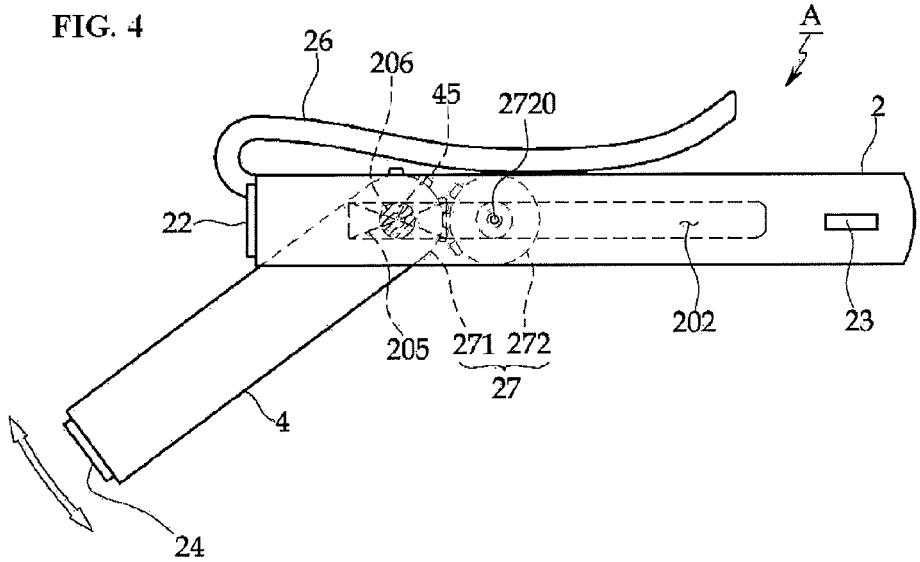
FIG. 4 is a sectional view of the light emitter of FIGS. 2-3.

FIG. 2 is a perspective view representing an exemplary light emitter A to be attached to a cap, FIG. 3 is a plan view representing the same light emitter A, and FIG. 4 is a sectional view representing the same light emitter A.

As shown in FIGS. 2 to 4, the light emitter A to be attached to caps includes a case 2 having a plurality of second lamps 22 formed at a front surface thereof, a power switch 23 attached to an outer surface of the case 2, a battery installed inside the case 2 to provide power, a guide channel 20 formed at the center of the case 2, a mounting clip 26 formed at the outer surface of the case 2, a sub-body 4 having a first lamp 24 at a front surface thereof and being coupled within the guide channel 20 to move back and forth or rotate, and a switch unit for controlling on/off operation of the first lamp 24.

Hereinafter, the elements of the light emitter A will be described in more detail.

As shown in FIG. 2, the case 2 has: the clip 26 formed at an upper surface of the case 2; the guide channel 20 formed at the front middle portion of the case 2 and extending inwardly within the case 2 by a predetermined length; the second lamps 22 formed at both sides of the guide channel 20 at the front side of the case 2; the battery mounted within the inside of the case 2 to provide power; and the power switch 23 formed at the outside of the case 2.

The guide channel 20 is formed as an inwardly-extending slot extending along the middle portion of the case 2. A rail channel 202 (FIGS. 3-4) is formed lengthwise along both inner sides of the guide channel 20.

For convenience's sake, the guide channel 20 is illustrated as visible from the outside of the case 2 in the drawings. However, preferably, a cover surface may be formed on an upper portion of the guide channel 20 in the same plane with the upper surface of the case 2.

The sub-body 4 has the first lamp 24 at the front surface thereof, and the sub-body 4 slides back and forth or rotates within the guide channel 20.

The forward movement of the sub-body 4 represents that the sub-body 4 is pulled out of the case 2, and the backward movement of the sub-body 4 represents that the sub-body 4 is inserted into the case 2.

As an example of a structure enabling the sliding movement of the sub-body 4 back and forth, as shown in FIGS. 3 and 4, the rail channel 202 is formed at a side surface of the guide channel 20, and a protrusion 45 is formed on the sub-body 4 such that the protrusion 45 is coupled to the rail channel 202 to slide back and forth.

According to another version of the invention, a cover surface extending from upper and/or lower surfaces of the case 2 is formed such that the sub-body 4 is inserted into the case 2. In this case, the rail channel 202 can be formed on the cover surface rather than the side surface of the guide channel 20, and the protrusion 45 is formed at upper and/or lower surfaces of the sub-body 4. Various other modifications for the back/forth movement structure may be apparent to those skilled in the art.

A structure for rotating the sub-body 4 will be described later.

The switch unit allows the first lamp 24 to be turned on upon the forward movement of the sub-body 4 and to be turned off upon the backward movement of the sub-body 4.

As an example, the switch unit can include a first contact point 205 installed at a front side of the rail channel 202 and a second contact point 206 formed at an outer circumference of the protrusion 45 of the sub-body 4.

That is, when the sub-body 4 moves forward, the second contact point 206 comes into contact with the first contact point 205, so that power is provided, thereby turning on the first lamp 24. In addition, when the sub-body 4 moves backward, the second contact point 206 is separated from the first contact point 205, so that the first lamp 24 is turned off.

Conversely, the switch unit can be set to be turned off upon the forward movement of the sub-body 4 and can be set to be turned on upon the backward movement of the sub-body 4. That is, the first contact point 205 may be installed at a rear side of the rail channel 202 such that the first contact point 205 and the second contact point 206 come into contact with each other and the first lamp 24 is turned on when the sub-body 4 moves backward. Otherwise, the contact points may be installed corresponding to a rear side of the sub-body 4 and the guide channel 20.

Meanwhile, the sub-body 4 is provided with a rotation part 27 such that the sub-body 4 is rotatable about the rotation part 27 to adjust the angle of the sub-body 4.

For example, in a state in which the first lamp 24 is turned on upon the forward or backward movement of the sub-body 4, the sub-body 4 is rotatable downward to emit light downwardly, so that a user can easily view matter positioned within a short distance.

As shown in FIGS. 2 and 4, as an example, the rotation part 27 includes a first gear 271 formed at a rear side of the sub-body 4 and a second gear 272 engaged with the first gear 271.

Meanwhile, the sub-body 4 further includes a fixing member 2720 (FIG. 3) for maintaining the sub-body 4 in an advanced position.

As shown in FIG. 3, the fixing member 2720 includes a projection member formed at both sides of the second gear 272 and a recess 2024 formed at both sides of the guide channel 20 corresponding to the projection member.

Preferably, the recess 2024 is formed inside the rail channel 202.

In detail, the projection member includes a steel sphere 2721 situated at an end of a bore formed at both sides of the second gear 272 and a spring 2722 installed to elastically bias the steel sphere 2721.

Accordingly, if the sub-body 4 moves forward, the second gear 272 moves forward in cooperation with the sub-body 4, and the projection member is inserted into the recess 2024, so that the sub-body 4 is fixed in the advanced state.

In a fixing member 2720 according to another version of the invention, the recess 2024 can be provided at the rear of both sides of the guide channel 20 such that fixing of the sub-body 4 occurs when the sub-body 4 moves backward.

However, the position of the projection member and the recess 2024 of the fixing member 2720 are not limited to the sides of the second gear 272 and the rail channel 202 as described above, but can be modified according to the intention of a designer.

Meanwhile, the rotation part 27 may be further provided with a brightness adjustment member (not shown) such that brightness of the first lamp 24 can be adjusted according to the rotation angle of the sub-body 4.

Preferably, the brightness adjustment member allows the first lamp 24 to have a low brightness upon downward rotation of the sub-body 4 and have a high brightness upon upward rotation of the sub-body 4.

That is, since the sub-body 4 is rotated downward for short-distance illumination, strong brightness is not needed. Also, since the sub-body 4 is rotated upward for long-distance illumination, strong brightness is needed, such that fatigue of the eyes of the user is relieved in the long distance illumination.

Since the brightness adjustment member is generally known in the art, the detailed description of the brightness adjustment member will be omitted. However, the brightness adjustment can be achieved by fabricating the rotation part 27 having a multi-contact point structure, and the brightness adjustment mechanism will be described in detail below.

In addition, the first lamp 24 uses a high intensity LED brighter than the second lamp 22. Accordingly, the lamps are selectively used according to the situation.

Meanwhile, in the event that the battery is discharged, an auxiliary battery is incorporated in the sub-body 4 or an auxiliary switch is installed on the sub-body 4. Otherwise, an auxiliary battery for the first lamp 24 can be incorporated in the case 2.

Accordingly, even when the second lamp 22 cannot be turned on due to discharge of the battery, the first lamp 24 of the sub-body 4 can emit light due to the auxiliary battery.

Hereinafter, a coupling structure and the operation of the light emitter A described above will be explained.

The sub-body 4 is inserted into the guide channel 20 of the case 2 such that the protrusion 45 is inserted into the rail channel 202.

After that, the battery is installed in the case 2.

The light emitter A coupled as described above is coupled to a visor of the cap using the clip 26.

After that, if the power switch 23 is switched on, the second lamp 23 is turned on, but the first lamp 24 is turned off.

If the sub-body 4 moves forward to turn on the first lamp 24, the first and second contact points 205 and 206 come into contact with each other, so that the first lamp 24 is turned on.

Otherwise, as described above, the light emitter A can be fabricated such that the first lamp 24 is turned on when the sub-body 4 moves backward. Such an on/off operation is selectively applied corresponding to the user's intention. The battery life can be extended through such an operation.

After that, the sub-body 4 can be rotated by the user to set a desired illumination angle.

In this case, if the sub-body 4 is rotated downward, the brightness of the first lamp 24 is decreased, and if the sub-body 4 is rotated upward, the brightness of the first lamp 24 is increased.

The light emitter A can be operated differently from the operations described above according to the user's, or the light emitter A can be operated at a constant brightness.

Even if the power switch 23 is unintentionally switched on when the light emitter A is carried in the pocket, the second lamp 22 is turned on, but the first lamp 24 is turned off. Accordingly, discharge of the battery is delayed, and the user can check the battery before the battery is completely discharged.

Accordingly, the battery is prevented from being completely discharged, so that lightening function of the light emitter A is maintained. In particular, since the auxiliary battery for the sub-body 4 is provided in the light emitter A, even if the brightness of the second lamp 22 is decreased, the performance of the first lamp 24 is maintained, thereby ensuring the lighting function.

Figure 5:
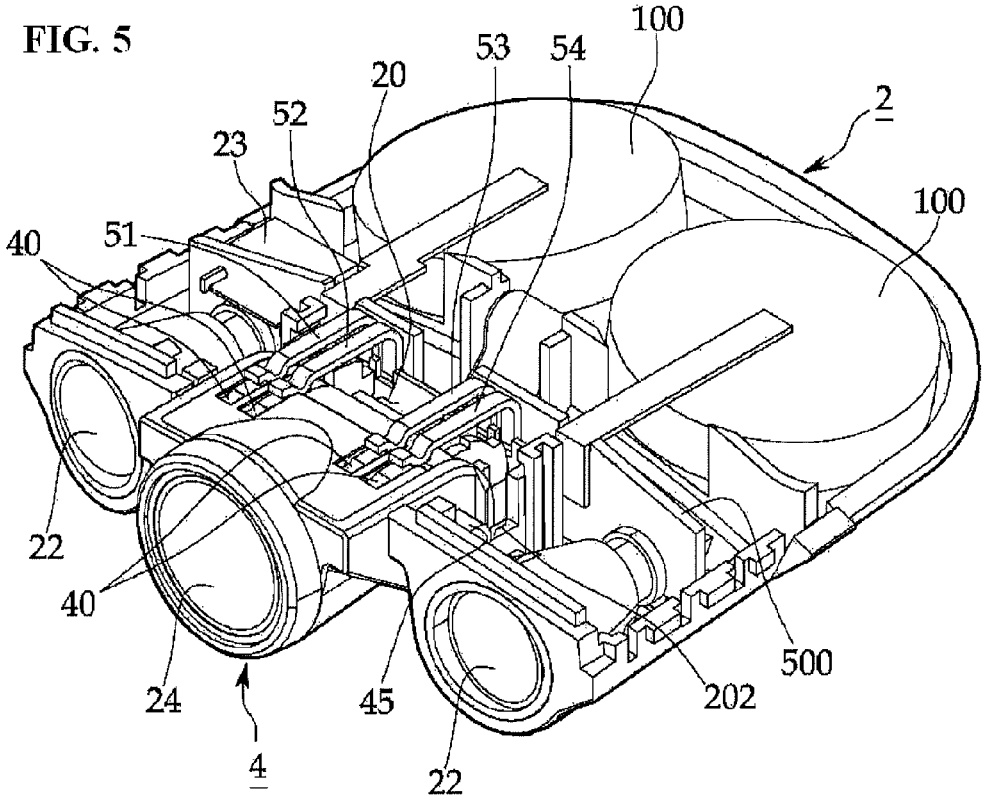
FIG. 5 is an exploded perspective view representing another version of a light emitter to be attached to a cap.

Meanwhile, FIG. 5 is an exploded view representing a light emitter to be attached to a cap according to another version of the present invention.

Figure 6:
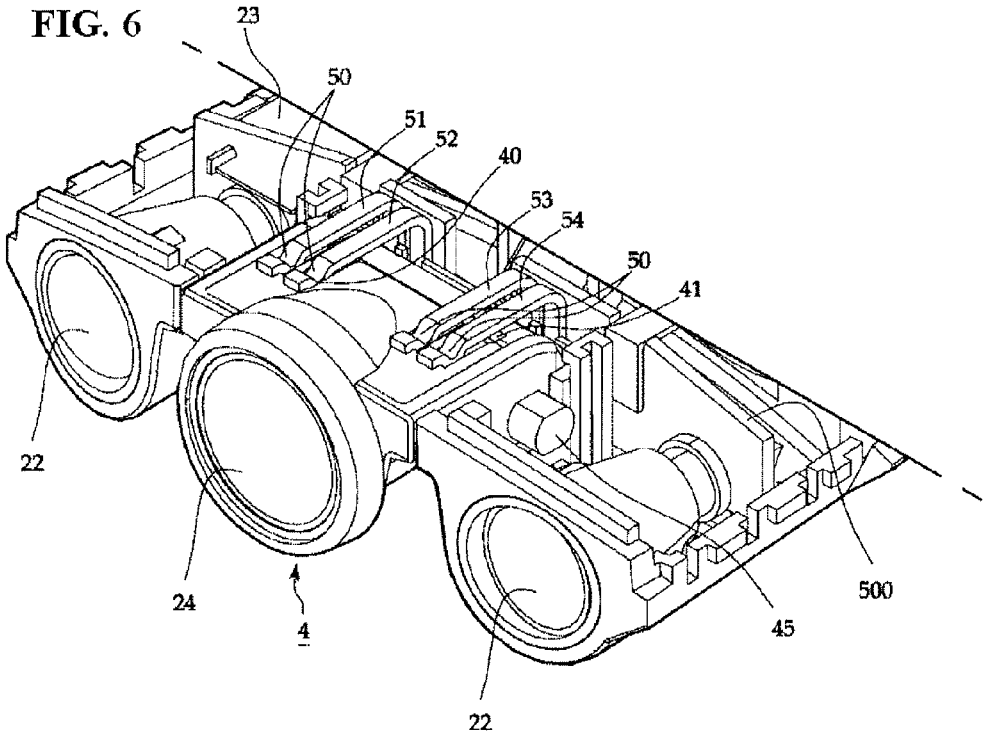
Figure 7:
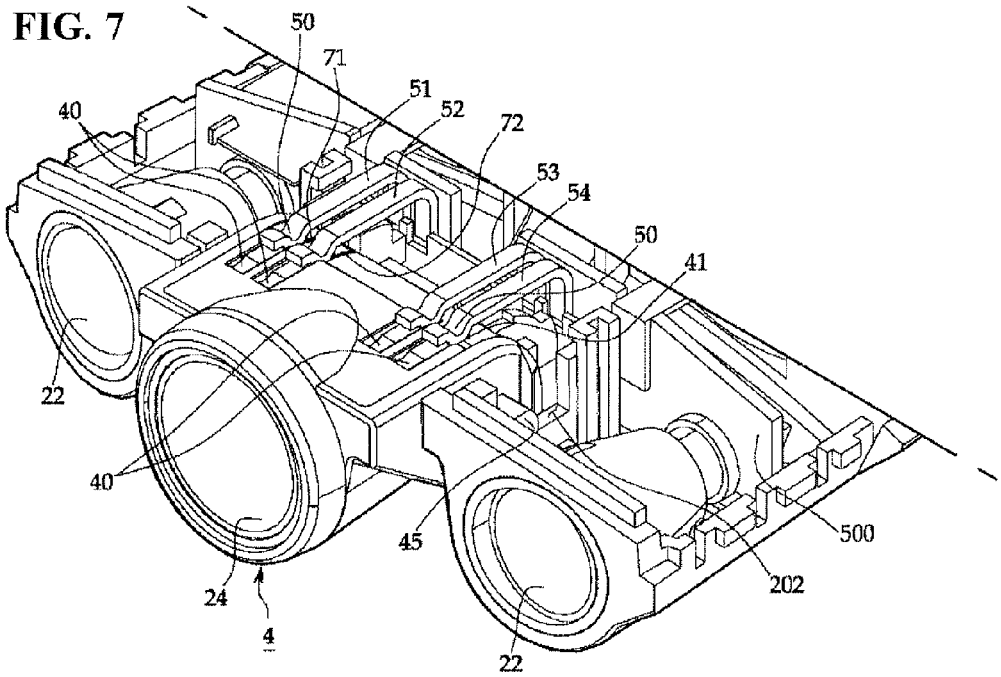
Figure 8:
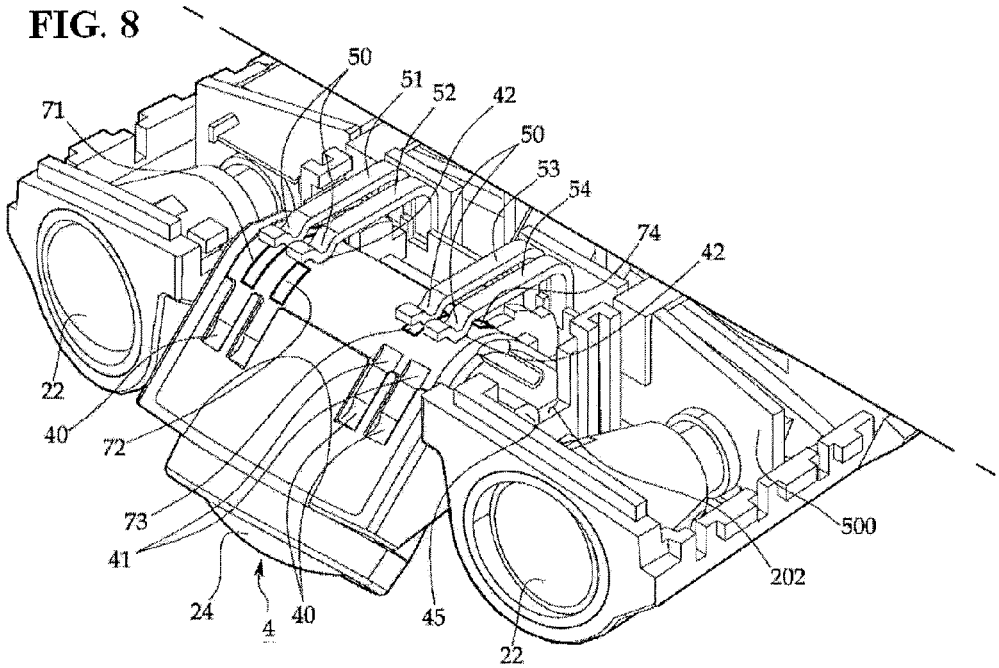
Figure 9:
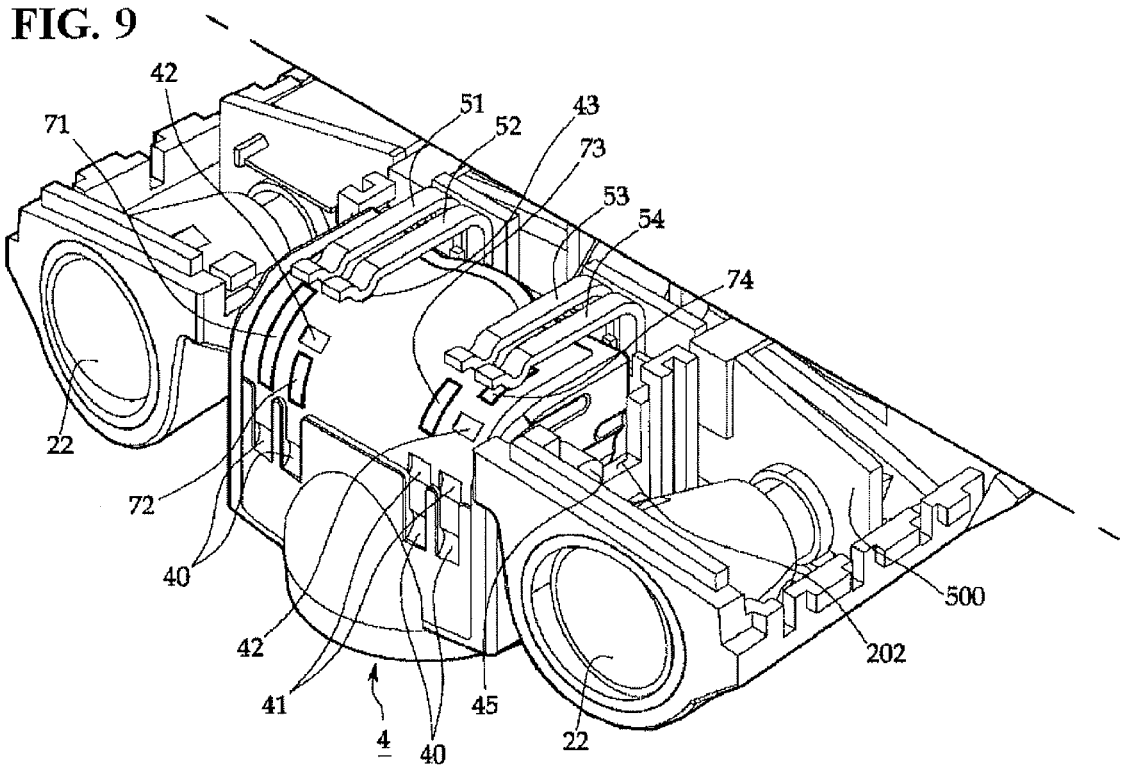

FIGS. 6 to 9 are enlarged views representing a switch unit used the second version of the present invention. FIG. 6 represents a state in which the sub-body moves backward, FIG. 7 represents a state in which the sub-body moves forward, FIG. 8 represents a state in which the sub-body rotates downward by a predetermined angle, and FIG. 9 represents a state in which the sub-body rotates into an upright position.

As shown in FIGS. 5 to 9, the switch unit includes a positive terminal 51 and first to third negative terminals 52 to 54, which are formed on a main electrode plate 500 electrically connected to a battery 100, and a negative plate 71 and first to third positive plates 72 to 74 that are formed on the sub-body 4 and come into contact with the positive terminal 51 and the first to third negative terminals 52 to 54, respectively.

The positive terminal 51 and the first to third negative terminals 52 to 54 extend in cantilever fashion from a main electrode plate 500, which is connected to the battery 100, to be supported to an outer surface of the sub-body 4.

The negative plate 71 and the first to third positive plates 72 to 74 have a band shape. Preferably, the negative plate 71 has a length longer than that of the first to third positive plates 72 to 74 at the rear side of the sub-body 4.

In particular, the negative plate 71 has a shape corresponding to the positive terminal 51, and the first to third positive plates 72 to 74 each have a shape corresponding to the first to third negative terminals 52 to 54.

Accordingly, when the sub-body 4 is pulled forward, the negative plate 71 comes into contact with the positive terminal 51, and the first positive plate 72 comes into contact with the first negative terminal 52 to provide power, so that the first lamp 24 is turned on.

In contrary, when the sub-body 4 moves backward, the negative plate 71 and the first positive plate 72 are separated from the positive terminal 51 and the first negative terminal 52, respectively, so that the first lamp 24 is turned off.

Meanwhile, as shown in FIGS. 6 to 9, the rotation part includes a channel formed at a rear side of the sub-body 4 and an elastic projection 50 inserted into the channel.

The channel includes a first channel 41, a second channel 42 and a third channel 43 that are formed at a rear end of the sub-body 4 to set the rotation angle.

The elastic projection 50 inserts into a fixing channel 40 and the first to third channels 41 to 43 to fix the position of the rotation part.

A curved surface having an arc shape is formed at the rear end of the sub-body 4.

As shown in FIG. 8, the first channel 41 is formed on an upper horizontal surface at a rear side of the sub-body 4 corresponding to the second and third negative terminals 53 and 54.

As shown in FIG. 8, several fixing channels 40 are formed at a front side of the first channel 41 such that the elastic projection 50 inserts into the fixing channel 40 to hold the sub-body 4 fixed when it moves backward.

The fixing channels 40 are formed on a position corresponding to the positive terminal 51 and the first to third negative terminals 52 to 54.

As shown in FIG. 9, the second channel 42 is formed on a surface of the sub-body 4 at which the upper horizontal surface and the rear curved surface of the sub-body 4 join each other. In particular, the second channel 42 is formed at a location corresponding to the first and third negative terminals 52 and 54.

As shown in FIG. 9, the third channel 43 is formed at the center of the rear curved surface of the sub-body 4 at a location corresponding to the first and second negative terminals 52 and 53.

The elastic projection 50 is formed by bending an end of the positive terminal 51 and the first to third negative terminals 52 to 54 downward.

However, the structure of the elastic projection 50 is not limited to the present version. The elastic projection 50 and the channels 40 to 43 could instead be formed in the guide channel 20.

Hereinafter, the operation of the sub-body 4 will be described.

As shown in FIG. 6, if the sub-body 4 moves backward, the elastic projection 50 of the positive terminal 51 and the first to third negative terminals 52 to 54 are fixedly inserted into the fixing channel 40. In this case, the first lamp 24 represents a turn-off state.

After that, as shown in FIG. 7, the sub-body 4 moves forward such that the elastic projection 50 of the second and third negative terminals 53 and 54 is fixedly inserted into the first channel 41.

At this time, the positive terminal 51 comes into contact with the negative plate 71 and the first negative terminal 52 comes into contact with the first positive plate 72 to provide power for the first lamp 24, thereby turning on the first lamp 24.

As shown in FIG. 8, when the sub-body 4 is rotated downward by a predetermined angle, the elastic projection 50 of the first negative terminal 52 and the third negative terminal 54 are inserted into the second channels 42, thereby fixing the sub-body 4 into the rotated state.

At this time, the positive terminal 51 is still in contact with the negative plate 71, and the second negative terminal 53 comes into contact with the second positive plate 73 to provide power for the first lamp 24, thereby turning on the first lamp 24.

After that, as shown in FIG. 9, the sub-body 4 further rotates into a vertical state, so that the elastic projection 50 of the first and second negative terminals 52 and 53 is fixedly inserted into the third channel 43.

At this time, the positive terminal 51 is still in contact with the negative plate 71, and the third negative terminal 54 comes into contact with the third positive plate 74 to provide power for the first lamp 24, thereby turning on the first lamp 24.

The number of channels formed on the sub-body 4 and the setting angle of the channels can be changed as desired.

The brightness of the first lamp 24 can be adjusted in accordance with the rotation angle of the sub-body 4 similarly to the arrangement described for the first version of the invention. The brightness can be adjusted by adopting a multi-point structure. As described above, several terminals and electrode plates are provided on the sub-body 4 such that several contact points are connected to a printed circuit board (not shown) installed in the light emitter. In this case, a circuit of the printed circuit board can be designed such that different amount of current can be applied to the respective contact points. Thus, the brightness can be changed depending on the connection state of the contact points to the circuit caused by the rotation of the sub-body 4.

Preferably, as shown in FIG. 6, when the sub-body 4 is situated in a horizontal state, the first lamp 24 has the strongest luminosity.

As shown in FIG. 7, when the sub-body 4 is slantingly rotated, the first lamp 24 emits light at a weaker intensity.

As shown in FIG. 8, when the sub-body 4 is rotated into the vertical state, the first lamp 24 emits light at the weakest intensity.

The above versions are illustrative, and the present invention is not limited thereto. The adjustment of the brightness can be provided in other forms.

Although few versions of the present invention have been shown and described, it would be appreciated by those skilled in the art that changes may be made in these versions without departing from the principles and spirit of the invention, the scope of which is defined in the claims and their equivalents.

What is claimed is:

1. A light emitter including:

a. a case having a front surface with a second lamp thereon;

b. a power switch attached to an outer surface of the case, the power switch activating the second lamp;

c. a mounting clip provided on the outer surface of the case;

d. a guide channel defined within the case;

e. a sub-body movably mounted within the guide channel, the sub-body having a first lamp thereon, wherein the sub-body is movable between:

(1) a stowed position wherein at least a major portion of the sub-body is situated within the guide channel, and (2) an unstowed position wherein the sub-body:

i. protrudes from the guide channel to a greater extent, ii. with less of the sub-body situated within the guide channel, than when in the stowed position.

2. The light emitter of claim 1 wherein the sub-body is both:

a. translatably mounted within the guide channel, whereby the sub-body may be adjustably respaced with respect to the case; and b. rotatably mounted within the guide channel, whereby the angle of the sub-body may be adjusted with respect to the case.

3. The light emitter of claim 1 wherein:

a. the sub-body has opposing sides with protrusions extending therefrom in opposite directions, and b. the guide channel has opposing sides into which the protrusions of the sub-body extend.

4. The light emitter of claim 3 wherein the protrusions of the sub-body are translatable within the opposing sides of the guide channel.

5. The light emitter of claim 4 wherein the protrusions of the sub-body are rotatable within the opposing sides of the guide channel.

6. The light emitter of claim 1 wherein:

a. the sub-body is translatable within the guide channel, b. the guide channel has a first electrical contact formed therein, and c. the sub-body has a second electrical contact formed thereon, and wherein the sub-body is translatable within the guide channel to move the second electrical contact into contact with the first electrical contact, thereby activating the first lamp.

7. The light emitter of claim 1 wherein:

a. the sub-body has:

(1) a front side, wherein the first lamp is on or adjacent to the front side, (2) an opposing rear side rotatably engaged with respect to the guide channel, and (3) electrical contacts spaced along the rear side, b. as the rear side of the sub-body rotates with respect to the guide channel, different ones of the contacts receive electricity to power the first lamp.

8. The light emitter of claim 1 wherein:

a. the sub-body has:

(1) a front side, wherein the first lamp is on or adjacent to the front side, and (2) an opposing rear side rotatably engaged to opposing sides of the guide channel, b. members facing the rear side engage the rear side as the rear side rotates, and provide resistance against rotation of the sub-body.

9. The light emitter of claim 8 wherein the rear side includes spaced channels formed therein, and wherein the members situated off of the rear side engage different ones of the channels as the rear side rotates.

10. The light emitter of claim 8 wherein the members engaging the rear side as the rear side rotates extend from the case, and have ends which are elastically urged towards the rear side.

11. The light emitter of claim 8 wherein the members engaging the rear side as the rear side rotates are electrically conductive terminals.

12. The light emitter of claim 8 wherein:

a. the rear side has a first gear thereon, and b. a second gear is situated within the guide channel, wherein the members engaging the rear side as the rear side rotates are defined by teeth on the second gear.

13. The light emitter of claim 12 wherein the second gear extends between opposing sides of the guide channel.

14. The light emitter of claim 1 wherein:

a. the sub-body has:

(1) a front side, wherein the first lamp is on or adjacent to the front side, and (2) an opposing rear side rotatably engaged within the guide channel, b. the brightness of the first lamp automatically varies in accordance with the degree of rotation of the rear side within the guide channel.

15. The light emitter of claim 1 wherein the first lamp of the sub-body and the second lamp of the case are powered by different power sources.

16. The light emitter of claim 1 wherein the case has:

a. two second lamps thereon on opposite sides of the guide channel, and b. two mounting clips thereon on opposite sides of the guide channel.

17. The light emitter of claim 1 wherein:

a. the case further includes opposing lateral sides extending rearwardly from the front surface, b. the guide channel extends rearwardly from the front side and between the lateral sides.

18. A light emitter including:

a. a case having:

(1) a rear side and an opposing front side, the front side having a second lamp thereon, and (2) a mounting clip provided on the outer surface of the case, b. a sub-body extending adjacent the case and being rotatably and translatably affixed to the case, the sub-body having a first lamp thereon, wherein the first lamp is activated when the sub-body is translated forwardly with respect to the case.

19. The light emitter of claim 18 wherein:

a. the case further includes:

(1) opposing lateral sides extending between the rear side and the front side, (2) a guide channel extending inwardly from the front side and between the lateral sides, and b. the sub-body is rotatably and translatably affixed to the case within the guide channel.

20. A light emitter including:

a. a case having:

(1) a rear side and an opposing front side, the front side having a second lamp thereon, and (2) a mounting clip provided on the outer surface of the case, b. a sub-body extending adjacent the case, the sub-body having:

(1) a front side, wherein a first lamp is on or adjacent to the front side, (2) an opposing rear side rotatably and translatably engaged with respect to the case, and (3) electrical contacts spaced along the rear side, wherein as the rear side of the sub-body rotates with respect to the case, different ones of the contacts receive electricity to power the first lamp.

* * * * *